US005516168A

United States Patent [19]

Tomaszewski-Link

[11] Patent Number: 5,516,168

[45] Date of Patent: May 14, 1996

[54] AUTOMOTIVE ADJUSTABLE TRUNK LOCK DEVICE

[76] Inventor: Patricia Tomaszewski-Link, 1870 Pappas Ct., Bellmore, N.Y. 11710

[21] Appl. No.: 319,461

[22] Filed: Oct. 6, 1994

[51] Int. Cl.[6] ..... E05C 17/44

[52] U.S. Cl. ..... 292/338; 292/274

[58] Field of Search ..... 292/338, 265, 292/267, 270, 274, 278, DIG. 14, DIG. 43

[56] References Cited

U.S. PATENT DOCUMENTS

| | | | |
|---|---|---|---|
| 1,595,555 | 8/1926 | Kooser | 292/267 |
| 1,615,035 | 1/1927 | Rasmussen | 292/265 |
| 2,766,960 | 10/1956 | Weber | 292/339 X |
| 2,974,989 | 3/1961 | Hilbers | 292/339 |
| 3,306,656 | 2/1967 | Hughes | 292/265 |
| 4,124,240 | 11/1978 | Adelberg | 292/339 X |

*Primary Examiner*—Steven N. Meyers
*Assistant Examiner*—Monica E. Millner
*Attorney, Agent, or Firm*—Michael I. Kroll

[57] ABSTRACT

An automotive adjustable truck lock device for a trunk lid of a trunk at a rear deck of an automobile, including a structure for maintaining the trunk lid in an open locked position, if a large article is placed in the trunk prevents the trunk lid from completely closing down on the trunk.

6 Claims, 2 Drawing Sheets

AUTOMOTIVE ADJUSTABLE TRUNK LOCK DEVICE

BACKGROUND OF THE INVENTION

1. Field of the Invention

The instant invention relates generally to motor vehicle trunks and more specifically it relates to an automotive adjustable trunk lock device.

2. Description of the Prior Art

Numerous motor vehicle trunks have been provided in prior art that are adapted to include lids that open and close, so that access to the trunks are available for storage of various articles therein. While these units may be suitable for the particular purpose to which they address, they would not be as suitable for the purposes of the present invention as heretofore described.

SUMMARY OF THE INVENTION

The automotive adjustable trunk lock device is a locking mechanism for an automobile trunk lid that employs two three position hinges with two integral locking members. It is fabricated from a steel alloy that is ideally suited for incorporation into the overall trunk lid design. The selection of this material also offers the surety of a device that can withstand its intended environment. It could also be installed with few modifications as an aftermarket package. The locks are integrated into the hinge design, appearing as indentations in the metal at three locations. The indentations conform to the outside diameter of the C-shaped clamps of the two locking members, which are permanently stored between the hinges under the rear deck. Each locking member is attached to a pivot on a mounting plate, which enables its easy deployment.

To use the device for locking the open trunk lid in place, the article to be carried within the trunk must be evaluated for its overall space requirements. Then, the trunk lid position that best corresponds to the articles features is selected. With this key parameter established, the locking members are rotated out of the storage position, where they will engage the indentations in the hinges. It is fast, easy and highly effective. The use of the locking members in preferable than using a rope or elastic strap. It will not scratch the paint on the inside of the trunk, nor wrist injury possible from a broken or worn strap. Anyone who uses an automobile trunk should appreciate the advantages of using this invention.

A primary object of the present invention is to provide an automobile adjustable trunk lock device that will overcome the shortcomings of the prior art devices.

Another object is to provide an automotive adjustable trunk lock device that is a locking mechanism for an automobile trunk lid, which will maintain the trunk lid in multiple open locked positions.

An additional object is to provide an automotive adjustable trunk lock device, in which two integral locking members are permanently stored between two hinges of the trunk lid under a rear deck, so that the locking members can be rotated out of storage to engage indentations in the hinges, to properly keep the trunk lid in a locked open position, if a large article placed in the trunk prevents the trunk lid from completely closing.

A further object is to provide an automotive adjustable trunk lock device that is simple and easy to use.

A still further object is to provide an automotive adjustable trunk lock device that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figure 1:
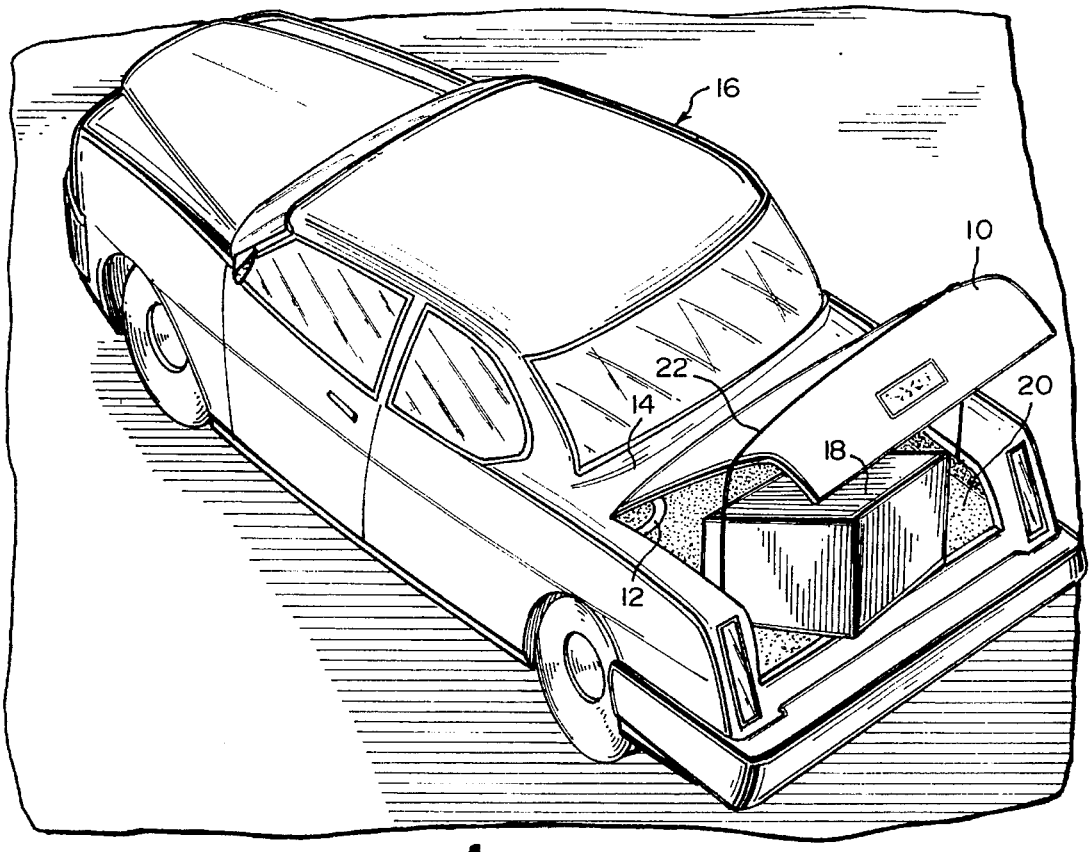
Fig. 1 (PRIOR ART)
FIG. 1 is a rear perspective view of the prior art, showing an automobile with its trunk lid open using a rope or elastic strap to secure the trunk lid.
Figure 2:
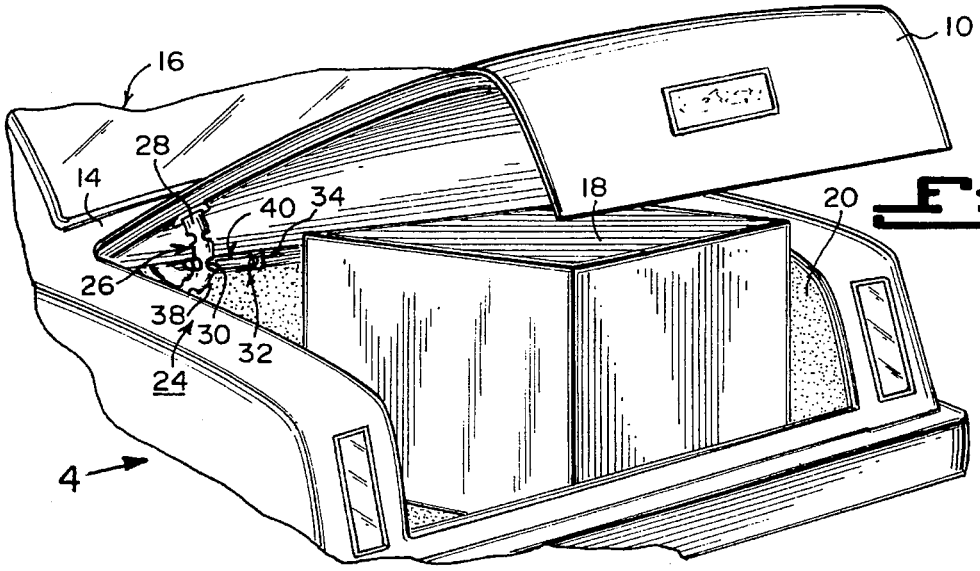
FIG. 2 is a rear perspective view of a portion of an automobile, showing the instant invention employed to the trunk lid in the medium position.

Turning now descriptively to the drawings, in which similar reference characters denote similar elements throughout the several views, FIG. 1 shows the prior art. The trunk lid 10 is connected by hinges 12 to a rear deck 14 of an automobile 16. The trunk lid 10 is wide open because a large article 18 is placed in the trunk 20. The trunk lid 10 is held in position by a rope or elastic strap 22.

The instant invention illustrated in FIGS. 2 through 5, is an automotive adjustable trunk lock device 24 for a trunk lid 10 of a trunk 20 at a rear deck 14 of an automobile 16, comprising a structure 26 for maintaining the trunk lid 10 in an open locked position, if a large article 18 is placed in the trunk 20 prevents the trunk lid 10 from completely closing down on the trunk 20.

The open locked position maintaining structure 26 includes a pair of support hinges 28, each having indentations 30. A pair of locking members 32 are also provided. Components 34 are for securing the locking members 32 to the underside of the rear deck 14 of the automobile 16. The locking members 32 can engage with the indentations 30 in the support hinges 28, to keep the trunk lid 10 in the open locked position over the large article 18 in the trunk 20.

Elements 36 are for storing the locking members 32 when not in use to the underside of the rear deck 14 of the automobile 16. The trunk lid 10 can operate normally to open and close in the trunk 20. Each support hinge 28 has at least a pair of indentations 30, with each indentation 30 located on an opposite edge 38 thereof.

Each locking member 32 consists of an L-shaped arm 40 having a long segment 42 and a short segment 44 bent at a right angle to the long segment 42. A C-shaped clamp 46 is on a distal end of the long segment 42 of the L-shaped arm 40, to engage with the indentations 30 in the support hinge 28.

Each securing component 34 includes a mounting plate 48 attached in a vertical position to the underside of the rear deck 14 of the automobile 16. A distal end of the short segment 44 of the L-shaped arm 40 can be attached thereto.

A facility 50 is for swiveling the short segment 44 of the L-shaped arm 40 on the mounting plate 48, so that the C-shaped clamp 46 can be properly manipulated to engage with the indentations 30 in the support hinge 28. The swiveling facility 50 is a pivot pin assembly 52 located between the distal end of the short segment 44 of the L-shaped arm 40 and the mounting plate 48.

Each storing element 36 for each locking member 32 includes a clip 54 affixed to the underside of the rear deck 14 of the automobile 16. A finger 56 extends from one side of the C-shaped clamp 46 perpendicular to the long segment 42 of the L-shaped arm 40. A contact head 58 is on a distal end of the finger 56, so as to be retained by the clip 54 when engaged thereto.

Figure 3:
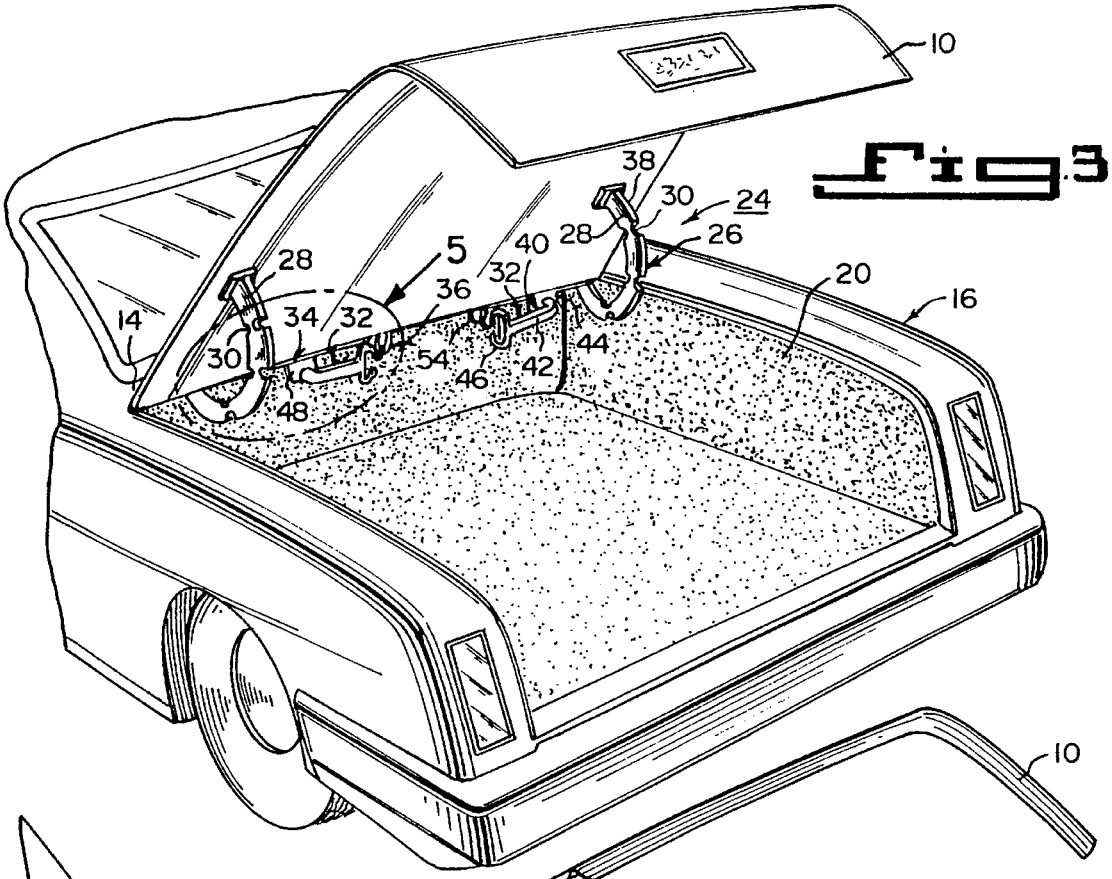
FIG. 3 is a rear perspective view similar to FIG. 2, showing the trunk lid open and the locking members stored therein.
Figure 4:
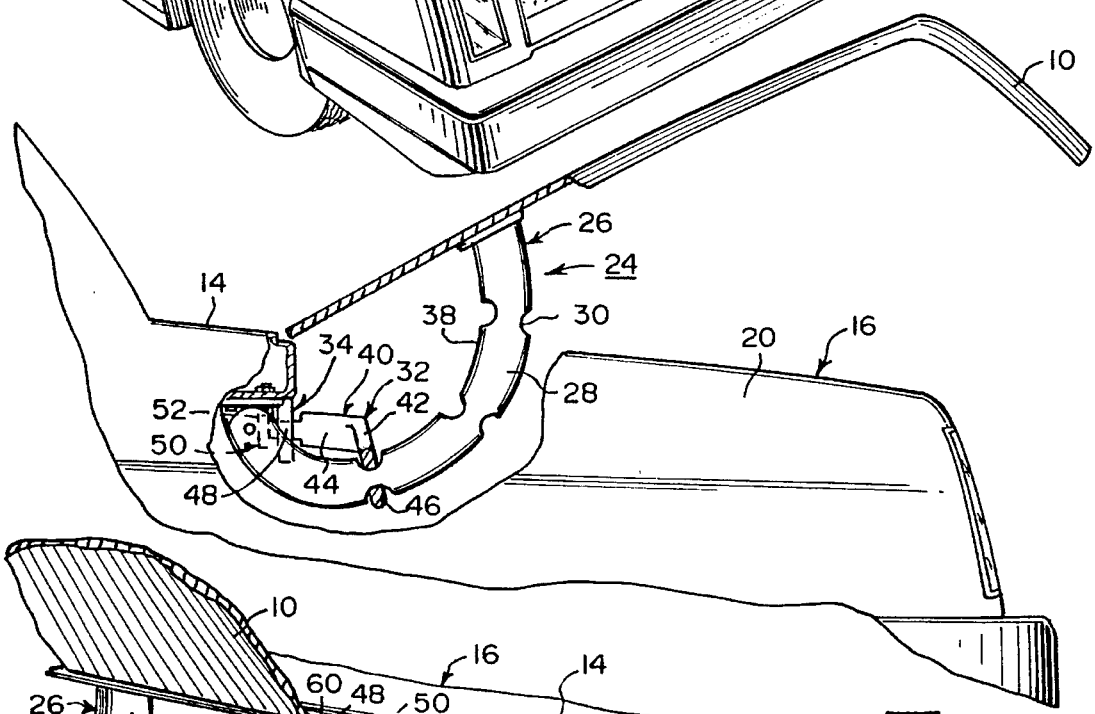
FIG. 4 is a side view taken in the direction of arrow 4 in FIG. 2, with the trunk lid in the high position.
Figure 5:
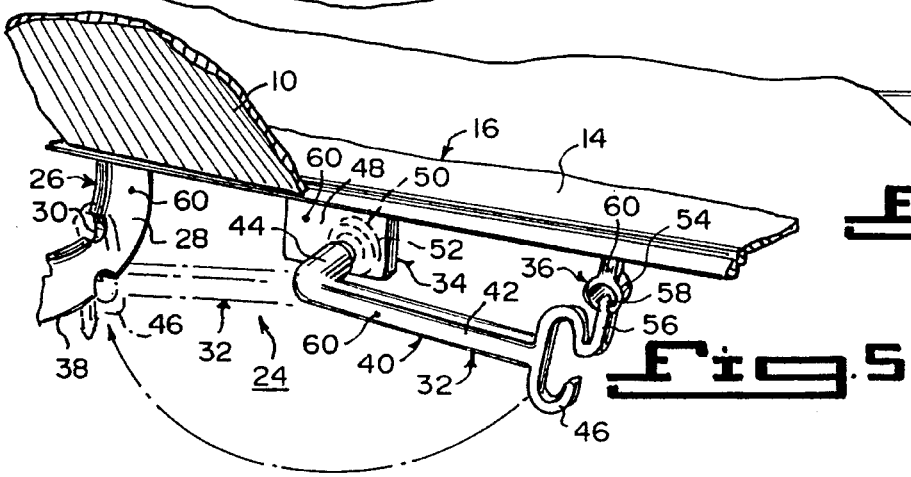
FIG. 5 is an enlarged perspective view as indicated by arrow 5 in FIG. 3, showing one locking member in greater detail.

As best seen in FIGS. 3 and 4, three pair of spaced apart indentations 30 are provided in each support hinged 28. The trunk lid 10 can be locked in a low position, a medium position and a high position depending upon the size of the article 18 placed within the trunk 20.

The support hinge 28, the L-shaped arms 40, the mounting plates 48 and the clips 54 are fabricated out of a steel alloy 60.

It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. An automotive adjustable truck lock device for a trunk lid of a trunk at a rear deck of an automobile, comprising means for maintaining the trunk lid in an open locked position, when a large article is placed in the trunk prevents the trunk lid from completely closing down on the trunk, said open locked position maintaining means including a pair of support hinges, each having indentations, a pair of locking members, and means for securing said locking members to an underside of the rear deck of the automobile, so that said locking members can engage with said indentations in said support hinges, to keep the trunk lid in the open locked position over said large article in the trunk, means for storing said locking members when not in use to the underside of the rear deck of the automobile, so that the trunk lid can operate normally to open and close the trunk, each support hinge having at least one pair of indentations, with each said indentation of the pair located on an opposite edge thereof, each locking member including an L-shaped arm having a long segment and a short segment bent at a right angle to said long segment, and a C-shaped clamp on a distal end of said long segment of said L-shaped arm to engage with said indentations in said support hinge, said securing means including a mounting plate for attachment in a vertical position to the underside of the rear deck of the automobile, so that a distal end of said short segment of said L-shaped arm can be attached thereto.

2. An automotive adjustable trunk lock device as recited in claim 1, wherein said securing means further includes means for swiveling said short segment of said L-shaped arm on said mounting plate, so that said C-shaped clamp can be properly manipulated to engage with said indentations in said support hinge.

3. An automotive adjustable trunk lock device as recited in claim 2, wherein said swiveling means is a pivot pin assembly located between the distal end of said short segment of said L-shaped arm and said mounting plate.

4. An automotive adjustable trunk lock device as recited in claim 3, wherein each said storing means for each said locking member includes:

a) a clip for attachment to the underside of the rear deck of the automobile;

b) a finger extending from one side of said C-shaped clamp perpendicular to said long segment of said L-shaped arm; and c) a contact head on a distal end of said finger, so as to be retained by said clip when engaged thereto.

5. An automotive adjustable trunk lock device as recited in claim 4, wherein three pair of spaced apart indentations are provided in each said support hinge, so that the trunk lid can be locked in a low position, a medium position and a high position to accommodate the size of the article placed within the trunk.

6. An automotive adjustable trunk lock device as recited in claim 5, wherein said support hinges, said L-shaped arms, said mounting plates and said clips are fabricated out of a steel alloy.

* * * * *